US007519280B2

(12) United States Patent
Yip et al.

(10) Patent No.: US 7,519,280 B2
(45) Date of Patent: Apr. 14, 2009

(54) APPARATUS AND METHOD OF REMOVING CARRIER FROM A RECORDING ELEMENT

(75) Inventors: Kwok-Leung Yip, Webster, NY (US); James E. Pickering, Bloomfield, NY (US); Po-Jen Shih, Webster, NY (US); Arthur M. Gooray, Penfield, NY (US); Charles F. Scaglione, Bergen, NY (US); Timothy J. Wojcik, Rochester, NY (US); Simon Yandila, Rochester, NY (US); Hwei-Ling Yau, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 387 days.

(21) Appl. No.: 11/475,696

(22) Filed: Jun. 27, 2006

(65) Prior Publication Data

US 2006/0291836 A1 Dec. 28, 2006

Related U.S. Application Data

(62) Division of application No. 10/851,912, filed on May 21, 2004, now abandoned.

(51) Int. Cl.
*D02J 13/00* (2006.01)

(52) U.S. Cl. ..... 392/417; 392/419

(58) Field of Classification Search ..... 392/417, 392/419, 407, 411

See application file for complete search history.

(56) References Cited

U.S. PATENT DOCUMENTS

| | | | |
|---|---|---|---|
| 3,745,307 | A | 7/1973 | Peek, Jr. et al. |
| 4,517,893 | A | 5/1985 | Wile et al. |
| 4,785,313 | A | 11/1988 | Higuma et al. |
| 4,832,984 | A | 5/1989 | Hasegawa et al. |
| 5,428,384 | A | 6/1995 | Richtsmeier et al. |
| 6,114,020 | A | 9/2000 | Misuda et al. |
| 6,120,199 | A | 9/2000 | Takekoshi |
| 6,244,700 | B1 | 6/2001 | Kimura et al. |
| 6,357,871 | B1 | 3/2002 | Ashida et al. |
| 6,406,118 | B1 | 6/2002 | Aoki et al. |
| 6,536,863 | B1 | 3/2003 | Beauchamp et al. |
| 7,025,450 | B2 | 4/2006 | Wojcik et al. |
| 2002/0008747 | A1 | 1/2002 | Kaga et al. |
| 2002/0027587 | A1 | 3/2002 | Sugaya et al. |

(Continued)

FOREIGN PATENT DOCUMENTS

| | | |
|---|---|---|
| DE | 201145 | 7/1983 |

(Continued)

OTHER PUBLICATIONS

Pending U.S. Appl. No. 10/731,335, filed Dec. 9, 2003, in the name of Pickering, et al.

*Primary Examiner*—Thor S Campbell
(74) *Attorney, Agent, or Firm*—William R. Zimmerli

(57) ABSTRACT

An apparatus and method of removing carrier from an article are provided. The apparatus includes a heater positioned to direct heat toward an article travel path. The heat has an emission spectrum with a peak emission wavelength and the carrier having an absorption spectrum with a peak absorption wavelength. The peak emission wavelength of the heat substantially corresponds to the peak absorption wavelength of the carrier.

4 Claims, 9 Drawing Sheets

U.S. PATENT DOCUMENTS

| | | | |
|---|---|---|---|
| 2004/0086666 | A1 | 5/2004 | Yoshimura et al. |

FOREIGN PATENT DOCUMENTS

| | | | |
|---|---|---|---|
| EP | 0284215 | A1 | 9/1988 |
| EP | 1284186 | A2 | 2/2003 |
| JP | 57-120447 | | 7/1982 |
| JP | 59-047406 | | 3/1984 |
| JP | 03-103156 | | 4/1991 |
| JP | 11-034310 | | 2/1999 |
| JP | 2000-030611 | | 1/2000 |
| JP | 2001-226618 | | 8/2001 |
| JP | 2002-283553 | | 10/2002 |
| WO | WO97/01449 | | 1/1997 |

ABSORPTION VS. WAVELENGTH FOR WATER AND PET
AND
EMISSION VS. WAVELENGTH FOR IR HEATER

APPARATUS AND METHOD OF REMOVING CARRIER FROM A RECORDING ELEMENT

CROSS REFERENCE TO RELATED APPLICATIONS

This is a divisional of application Ser. No. 10/851,912, filed May 21, 2004 now abandoned.

Reference is made to commonly assigned U.S. patent application Ser. No. 10/731,335, entitled "APPARATUS AND METHOD OF TREATING A RECORDING ELEMENT filed on Dec. 9, 2003," in the name of James E. Pickering, et al., and U.S. Pat. No. 7,025,450 issued Apr. 11, 2006, in the name of Timothy J. Wojcik, et al.

FIELD OF THE INVENTION

This invention relates generally to an apparatus and method of treating a recording element and, more particularly, to an apparatus and method of removing carrier from an imaged and/or printed recording element.

BACKGROUND OF THE INVENTION

Inkjet printing is a non-impact printing method that, in response to a digital signal, produces droplets of ink that are deposited on a recording element. Today, inkjet printing systems are used in a variety of capacities in industrial, home, and office environments. The quality of inkjet prints continues to improve, however, inkjet prints are disadvantaged because they lack durability, often being less stable relative to environmental factors (light, ozone, etc.) and more sensitive to water and abrasion.

One way of overcoming these disadvantages is to laminate or encapsulated inkjet prints. When an inkjet print is laminated, a transparent overlay is adhered to the inkjet print. Typically, this is accomplished using an adhesive activated by heat, pressure, or both. The transparent overlay physically protects the print and seals it from ingress of water. When an inkjet print is encapsulated, the print is positioned between two laminating sheets, at least one of which is transparent. Then some combination of the print and the laminating sheets are adhered usually using an adhesive activated by heat, pressure, or both. Typically, encapsulation is most effective when the laminating sheets extend beyond the print and are bonded to each other at the extremities, thus preventing ingress of water through exposed edges of the print.

Lamination and encapsulation both have disadvantages in that they are expensive processes requiring additional materials and handling by the user. Moreover, inkjet inks remained trapped within the recording element which can degrade image quality by causing stain or migration of the print on storage or exposure. Laminate materials and adhesives can often deteriorate over time causing surface defects including, for example, cracking. Laminates do not always adhere well to inkjet prints. The quality and uniformity of adhesion can depend on the material nature of the recording element, the type of ink, and the volume of ink printed per unit area of recording element (ink laydown). The latter is particularly significant when the inkjet print has photographic image quality because heavy laydowns of ink are necessary to achieve the necessary superb image quality.

As an alternative to lamination or encapsulation, inkjet recording elements having a nascent protective layer coated on a support are known. The nascent protective layer is really a special chemical layer designed such that during the inkjet printing process, the inks penetrate the layer, and after printing is complete, the layer is fused using heat and/or pressure so that it seals and protects the print. This process is often referred to as the incorporated approach because the nascent protective material is incorporated into the recording element during its production.

However, the incorporated approach is limited because it is difficult to obtain a final protected print that is uniform in gloss and clarity and free of surface defects such as blistering and cracking. Limitations are especially apparent when the final protected print must have superb image quality, e.g., when it is for photographic or medical diagnostic applications. A recording element for these applications may have one or more of these layers underlying the nascent protective layer to help manage a heavy laydown of ink. After printing, the bulk of the ink, commonly referred to as the carrier, is retained somewhere in the dual layer system. If too much carrier resides in the nascent protective layer during fusing, it will not fuse properly and any of the aforementioned undesirable effects may be observed.

This condition worsens when the carrier resides predominately in an ink-receiving layer during and/or after fusing of the nascent protective layer, and then migrates within the ink-receiving layer, or from the ink-receiving layer and into the fused protective layer. Migration of the carrier within the ink-receiving layer causes deterioration of image quality, e.g., loss of image sharpness and blotchiness, and migration into the fused protective layer causes any of the aforementioned undesirable effects.

Examples of inkjet printing methods that employ the incorporated approach are described in U.S. Pat. No. 6,114,020, issued to Misuda et al., on Sep. 5, 2000; U.S. Pat. No. 4,832,984, issued to Hasegawa et al., on May 23, 1989; and U.S. Pat. No. 4,785,313, issued to Higuma et al., on Nov. 15, 1988.

European Patent Application 1 284 186 A2 describes a fixing apparatus and an image fixing method for improving the gloss of an inkjet image recorded on an inkjet recording material. The inkjet recording material includes a porous top layer which can be thermally fixed. After the image has been printed, the recording material is held in "a suspended state" before it is passed between a pair of fixing belts or rollers that are held at some elevated temperature and pressure.

Japanese Unexamined Patent Publication 2002-283553 A describes an inkjet recording device for controlling the gloss and clarity of an image surface of a recording medium. The device includes inkjet printing means for generating a printed image on a recording medium and fixing means for heating and pressing the printed image. The recording medium has a thermoplastic resin layer that receives ink and is subsequently fixed.

U.S. Patent Application Publication 2002/0027587 A1 describes an apparatus and method for forming prints. A recording medium having thermoplastic resin particles on a surface layer is printed. Subsequently the resin particles are made transparent by a heating and pressing device. U.S. Patent Application Publication 2002/0008747 A1 describes a similar method.

U.S. Pat. No. 6,357,871 B1 describes an inkjet recording medium and apparatus for preparing an inkjet printed product. The inkjet recording medium has a layer of fine particles of a thermoplastic organic polymer that are dissolved or melted after inkjet recording to form a layer wherein the particles are fused to one another. Fusing the particles involves a step of heating the layer followed by an impressing step of passing the recording medium between a pair of press rolls while the layer is still in a plastic state after the heating step.

All of the aforementioned art are disadvantaged in that the bulk of the ink, or carrier, is trapped within the recording element after the protective layer is formed which leads to the problems described above. Therefore, there is a need for an apparatus and method that removes carrier from an imaged and/or printed recording element before the recording element is fused.

Japanese Patent Laid Open Application No. 57-120447, discloses a heating and drying device using far infrared rays having a spectrum of 4 um to 400 um in an inkjet recording apparatus. The radiant energy intensity has a peak at a wavelength around 3.5 um followed by a broad emission band having a wavelength range from 4 um to greater than 50 um. However, if such a far infrared dryer is used, both the ink and the recording medium are heated, resulting in a low efficiency for heating the ink image. Here, only 50% of ink carrier can be dried at a recording medium feeding speed of 0.5 cm per second, yielding a very slow drying speed. Also, as most of the radiant energy is used to heat the recording medium, image artifacts such as yellowing and cockle would occur.

European Patent Application 0284215 A1 discloses a method and apparatus for uniformly drying ink on a paper after it is printed by an inkjet print head. In this method, an elongated infrared lamp with tungsten filament is used as the heat source and is located at the symmetry axis of a semi-cylindrical reflector forming a paper transport path. As the printed paper is fed along the interior cylindrical surface of the heat reflector, the paper receives a uniform heat flux and is dried uniformly. However, the color temperature of the tungsten-filament lamp is in general between 2300° K. and 3400° K., producing an emission spectrum in the near infrared range (the corresponding wavelength for maximum emission is between 0.85 um and 1.26 um). As the emission spectrum of the lamp does not match the absorption spectrum of the aqueous ink (for water the wavelength for maximum absorption is about 3.0 um), low drying efficiency is resulted.

U.S. Pat. No. 5,428,384 discloses a heater blower system in a color inkjet printer. This system uses a combination of air blowing over the image side of the medium, together with a radiant heater to heat the underside of the medium during the printing of an image, resulting in the evaporation of the ink carrier from the medium. In addition, an exhaust fan and duct system is used to effectively remove the vapor thus generated from the printer. However, the ink droplets adsorbing to the medium are caused to spread by the draft from the blower. Thus, ink mist flies to spread in the blowing direction and adheres to the circumference of the printed images, leading to the degradation of image quality. Also, since the radiant heater is located in the printing zone, facing the print head, the ink accumulated on the nozzle plate and/or near the nozzle would be dried out causing erratic ejection of droplets and possibly failure of ejection.

U.S. Pat. No. 6,244,700 B1 discloses an inkjet recording apparatus with a fixing heater that radiates infrared radiation having a maximum value within a range of wavelength from 4 um to 10 um. This heater is formed by coating a complex film containing Si, Fe, Zr, Ti, and Mn on the surface of a ceramic heater. The heater is arranged in a position, facing the print head, to heat the recoding medium and ink carrier from the reverse side (not the image side) of the medium through a screen grid supporting the medium. This method provides a compact and efficient heating device for drying and fixing the image with a lesser dissipation of power. However, as the heater is located in the printing zone, facing the print head, the ink accumulated on the nozzle plate and/or near the nozzle would be dried out causing erratic ejection of droplets and possibly failure of ejection. Moreover, although the heater provides a broad band radiation in the range of 2 um-34 um, the peak of radiation at about 7 um does not match the infrared absorption of aqueous ink having its main absorption peaks at around 3.0 um and 6.1 um. As a result, the heating effect on the ink in not optimal.

WO 97/01449 discloses a method of treating a coated medium after it has been printed by an inkjet print head. It first uses a stream of steam at a temperature of 100° C. or over and for between 0.1 to 100 seconds, and then applies heat on the printed medium for between 0.1 and 100 seconds so that the surface temperature of the medium is between 60° C. and 150° C. However, the hot steam and the subsequent condensation of water would perturb the ink droplets adsorbing to the medium resulting in severe image degradation.

U.S. Pat. No. 6,120,199 describes an inkjet printing apparatus having a heating fixation unit and a fixing unit. The heating fixation unit includes a fan that blows heated air over the surface of an imaged recording medium in an attempt to dry the surface before it enters the fixing unit. While ink solvent is allowed to escape from the imaged recording medium, the amount of ink solvent removed cannot be adequately controlled. Therefore, the reliability of the apparatus is reduced.

U.S. Pat. No. 6,406,118 B1 discloses an inkjet recording apparatus having a post-printing heat fixing station that consists of both a conductive heating platen to heat the unrecorded face of the recording material and a fan blowing hot air generated by a halogen heater to heat the ink bearing face of the recording material. Consequently, both faces of the recording material are sufficiently dried to accelerate the ink penetration, and the fixing time is significantly reduced. However, the draft from the blower would perturb the ink droplets adsorbing to the recording material, resulting in the degradation of image quality.

There is a need for an apparatus and method that removes carrier from an imaged and/or printed recording element, and subsequently increases a durability characteristic of the imaged and/or printed recording element while optimizing and/or controlling the conditions for each depending on the requirements of the imaged and/or printed recording element being dried.

SUMMARY OF THE INVENTION

According to one feature of the invention, a method of removing carrier from an article comprises applying heat from a heater to the article, the heat having an emission spectrum with a peak emission wavelength, the carrier having an absorption spectrum with a peak absorption wavelength, the peak emission wavelength of the heat substantially corresponding to the peak absorption wavelength of the carrier.

According to another feature of the invention, a carrier removal station includes a heater positioned to direct heat toward an article travel path defining an article travel direction. The heat has an emission spectrum with a peak emission wavelength and the carrier has an absorption spectrum with a peak absorption wavelength. The peak emission wavelength of the heat substantially corresponds to the peak absorption wavelength of the carrier.

Preferably, a first heating element of the carrier removal station has a length L1, the length L1 extending along a maximum width of the article travel path. A second heating element of the carrier removal station has a length L2, the length L2 being less than the length L1, the second heating element being positioned parallel to the first heating element and spaced apart from the first heating element relative to the article travel direction of the article travel path, and one end of the second heating element being aligned with one end of the first heating element. A third heating element of the carder removal station has a length L3, the length L3 being substantially equal to the length of the second heating element L2, the third heating element being positioned parallel to the first heating element and axially aligned with the second heating element and one end of the third heating element being aligned with a second end of the first heating element.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Referring to FIGS. 1-11, example embodiments of the invention are shown with like components being described using like reference symbols. Although the embodiments of the invention are suited for obtaining monochrome or multicolored transparent prints typically used in medical diagnostic imaging applications, the embodiments of the inventions also find application in other areas, for example, in obtaining monochrome or multicolor reflective prints suitable for use in medical diagnostic imaging applications, photographic applications, etc.

Figure 1:
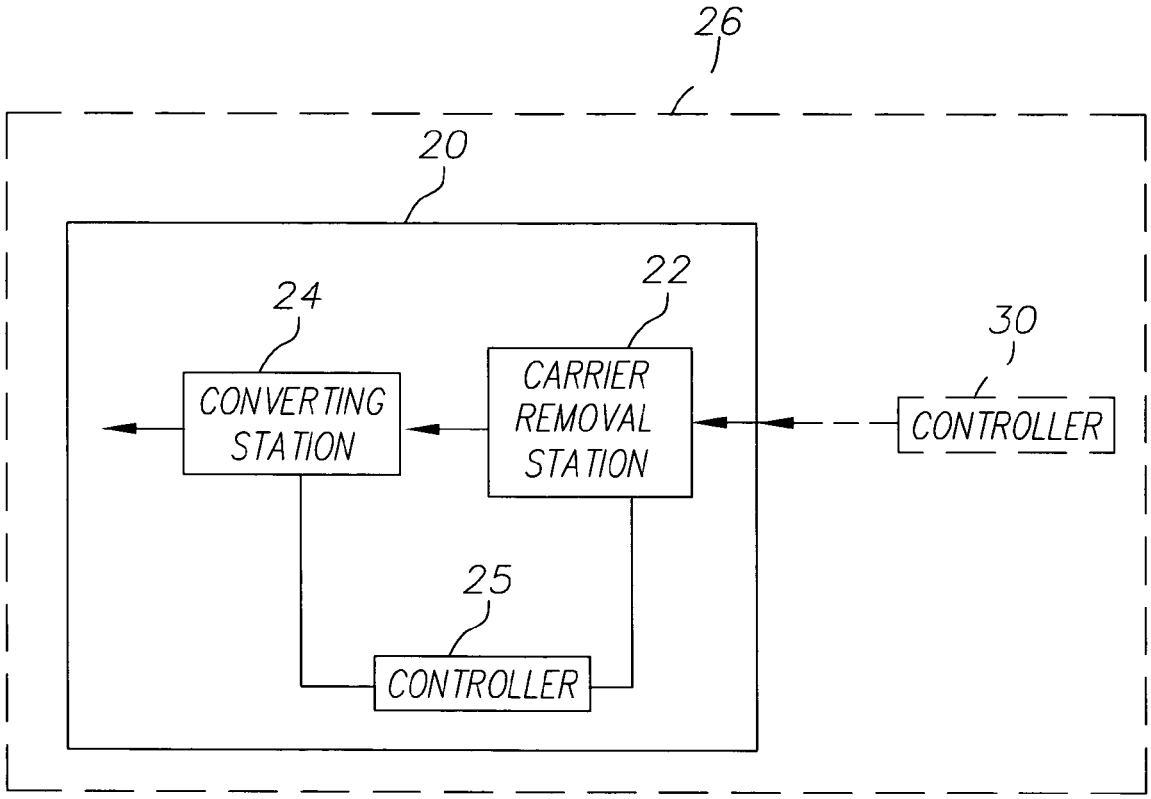
FIG. 1 is a block diagram of an apparatus made in accordance with the invention.

Referring to FIG. 1, a block diagram of a recording element treating apparatus 20 is shown. Apparatus 20 includes two stations—a carrier removal station 22 which removes carrier, typically an ink carrier, from a recording element and a converting station 24 which increases, or improves, a durability characteristic of the recording element. Carrier removal station 22 and converting station 24 are connected to a conventional controller 25 which allows either and/or both stations 22 and 24 to be individually controlled, programmed, and/or adjusted depending on one or more factors. These factors include, for example, media type, ink type, desired image resolution, etc. Controller 25 can include a user interface, as is known in the art, or can be of the type that adjusts operating parameters automatically based on, for example, information received from other components of the apparatus 20 and/or printing system 26 (discussed below).

As used herein, durability characteristic refers to any characteristic related to the preservation of an imaged recording element, or inkjet print. For example, durability characteristic refers to the stability of an inkjet print towards environmental factors such as light and ozone which can cause discoloration or fading of the imaged recording element. Other examples of durability characteristics include the stability or resistance of an inkjet print towards humidity, water, staining, and physical abrasion.

Apparatus 20 can be incorporated into a conventional printing system 26. In this context, conventional printing systems include any printing system that deposits one or more inks onto and/or into a recording element, for example, an inkjet printing system, etc. The embodiments discussed below are done so in the context of an inkjet printing system 26. However, any type of printing system 26 that deposits a liquid, for example, a colorant having a carrier can be used with apparatus 20. When incorporated into printing system 26, controller 25 can also be incorporated into system 26 and/or included in addition to any printing system controllers.

Typically, an inkjet printing system 26 includes one or more printheads, recording element conveying systems, controllers, user interfaces, etc. (shown generally using 30). Inkjet printing system 26 can include a drop-on-demand type printer employing a piezoelectric printhead or a thermal printhead. Alternatively, system 26 can include a continuous type printer. Ink drop formation can be accomplished using any conventional technique.

Any conventional inkjet ink can be deposited on and/or in the recording element using inkjet printing system 26. Typical inkjet inks are either aqueous-based or solvent-based and include mostly carrier and a small amount of pigment and/or dye colorant. For aqueous-based inks, water and water-miscible humectants and co-solvents such as polyhydric alcohols such as diethylene glycol or glycerol are the carrier. Solvent-based inks contain one or more organic solvents as the carrier; for example, alcohols such as methanol, ethanol, propanol, iso-propanol; ketones such as acetone, methyl ethyl ketone, methyl isobutyl ketone, cyclohexanone and 4-methoxy-4-methylpentanone; hydrocarbons such as cyclohexane, methylcyclohexane, n-pentane, n-hexane and n-heptane; esters such as ethyl acetate and n-propyl acetate; dimethyl sulfoxide; n-methyl-2-pyrrolidone; γ-butyrolactone; toluene; xylene and high-boiling petroleums. The choice of carrier is not particularly limited, as long as it can be removed by the carrier removal station 22 without causing deformation or deterioration of the recording element or the image printed thereon.

In one embodiment, aqueous-based inks are used with the invention to generate inkjet prints. Examples of aqueous-based inkjet inks include any inkjet ink commercially available from, for example, Canon, U.S.A., Inc.; Epson America, Inc.; Hewlett-Packard Co.; Eastman Kodak Co.; etc.

Pigment or dye colorant components of inks used with inkjet printing system 26 have either chromatic color such as cyan, magenta, yellow, orange, green, or violet, or they can have achromatic color such as black, white, gray or colorless. In certain imaging applications, inks having the same hue but different densities are employed. For example, an inkjet printer designed for rendering medical images typically employs a set of black inks, wherein each ink in the set has the same hue but a different density in order to generate high-quality multilevel grayscale images.

Pigment colorants useful in the inks that can be employed in inkjet printing system 26 include any known pigment, or combination of pigments, commonly used in the art of inkjet printing. Such pigments include azo pigments, naphthol pigments, benzimidazolone pigments, metal complex pigments, phthalocyanine pigments, quinacridone pigments, perylene and perinone pigments, anthrapyrimidone pigments, flavanthrone pigments, anthanthrone pigments, dioxazine pigments, titanium oxide, iron oxide, carbon black and the like. Preferred pigments are C.I. Pigment Blue 15:3; the bridged aluminum phthalocyanine pigment described in U.S. Patent 5,738,716; C.I. Pigment Red 122; C.I. Pigment Yellow 155; C.I. Pigment Yellow 74; C.I Pigment Yellow 97; C.I Pigment Yellow 128 or C.I. Pigment Black 7, because combinations of these pigments tend to provide the best color. The exact choice of pigment will depend upon the specific application and performance requirements such as color reproduction and image stability.

Pigment colorants useful in the inks that can be employed in inkjet printing system 26 generally have average particle sizes of less than about 500 nm. Preferably, the average particle size is less than 200 nm, and especially less than 90 nm, because inks formulated with pigments having these particle sizes tend to jet reliably. For aqueous-based inks containing pigment colorants, a dispersant is typically used to stabilize the pigment particles against flocculation and settling. Dispersants are typically used to mill the pigment particles to an appropriate size, as described, for example, in U.S. Pat. Nos. 5,679,138; 5,085,698 and 5,172,133 and are added to the ink as part of the pigment itself. Dispersants may also be added separately from the pigment. Self-dispersing pigments may also be used; these types of pigments are inherently stable against flocculation and settling and do not require a dispersant.

Dye colorants useful in the inks that can be employed in inkjet printing system 26 include any known dye, or combination of dyes, commonly used in the art of inkjet printing. Such dyes include water-soluble reactive dyes, direct dyes, anionic dyes, cationic dyes, acid dyes, food dyes, metal-complex dyes, phthalocyanine dyes, anthraquinone dyes, anthrapyridone dyes, azo dyes, rhodamine dyes, and the like. Typical examples of dyes include C.I. Direct Yellow 86, 107, 132, 173; Acid Yellow 17 and 23; C.I. Reactive Red 23, 24, 31, 120, 180, 241; Acid Red 35, 52, 249, 289, 388; Direct Red 227; CAS No. 224628-70-0 sold as JPD Magenta EK-1 Liquid from Nippon Kayaku Kabushiki Kaisha; CAS No. 153204-88-7 sold as Intrajet® Magenta KRP from Crompton and Knowles Colors; the metal azo dyes disclosed in U.S. Pat. Nos. 5,997,622 and 6,001,161; C.I. Direct Blue 86, 199, 307; Acid Blue 9; Reactive Black 31; Direct Black 19, 154, 168; Food Black 2; Fast Black 2, Solubilized Sulfur Black 1 (Duasyn® Black SU-SF). The exact choice of dye will depend upon the specific application and performance requirements such as color reproduction and image stability.

Humectants, co-solvents, surfactants, defoamers, buffering agents, chelating agents, and conductivity-enhancing agents are usually employed in inkjet inks for a variety of reasons, most of which are dictated by the requirements of the printhead from which they are printed. Thermal and piezoelectric drop-on-demand printheads and continuous printheads each require inks with a different set of physical properties in order to achieve reliable and accurate jetting of the ink, as is well known in the art of inkjet printing. Humectants, co-solvents and surfactants are also used to prevent the inks from drying out or crusting in the orifices of the printhead, aid solubility of the components in the ink, and facilitate penetration of the ink into the recording medium after printing. A typical aqueous-based ink useful in the inkjet printing system 26 may contain, for example, the following components based on the total weight of the ink: colorant 0.05-10%, water 20-95%, humectant(s) 5-70%, co-solvent(s) 2-20%, surfactant(s) 0.02-10%, and biocide(s) 0.05-5%, and have a pH of 2-10.

Although the inks described above are conventional inkjet inks, any fluid that can be jetted using an inkjet printer can be used in inkjet printing system 26, as long as the fluid includes a carrier that can be removed by the carrier removal station without causing deformation or deterioration of the recording element itself or the image printed thereon. Other examples of fluids that can be used in inkjet printing system 26 include radiation-curable inks, and colorless inks containing fragrance agents, flavoring agents, or compounds that are used to provide security features such as near-infrared fluorescent compounds, UV-absorbing compounds, and the like.

Any recording element can be used with apparatus 20 provided the recording element is capable of absorbing ink and undergoing a durability characteristic change or alteration. Again, durability characteristics include, but are not limited to, resistance to water, stains, light, ozone, scratches, rubbing, etc. The recording element typically includes a support having at least one ink-receiving layer coated thereon. For recording elements having a single ink-receiving layer coated on a support, the layer should be of the type that initially allows absorption of the ink, and then permits at least some of carrier (for example, some of the water) to be removed from it, and at least a portion of the layer should be of the type that a durability characteristic of the recording element can be increased.

Recording elements that can be used with apparatus 20 may also consist of a plurality of ink-receiving layers wherein the layers provide the same or different functions. For example, one layer may be used to trap dye or pigment colorant, and another layer may be used to trap any of the other ink components including carrier. The layers may be in any order on the support, as long as the uppermost layer (the layer that first receives ink) is of the type that a durability characteristic of the recording element as a whole is capable of being increased. Durability characteristics of the other layers may also be changed, preferably increased, as long as the uppermost layer can be converted to increase a durability characteristic of the recording element as a whole. The layers should be optimized relative to one another such that the recording element as a whole initially allows absorption of the ink, and then permits at least some of the carrier to be removed from at least one of the layers and from the recording element as a whole.

In one embodiment of the invention, the recording element has a single layer coated on a porous support such that the colorant is trapped in the single layer before and after a durability characteristic of the layer has been increased, and such that any remaining carrier including humectants, co-solvents and water can evaporate from the recording element through the porous support over time after a durability characteristic has been increased.

In another embodiment of the invention, the recording element has two layers, an uppermost layer coated on an underlying layer that is coated directly on a nonporous or porous support. The uppermost layer traps the colorant and both layers absorb the remainder of the ink. Both layers function together such that carrier removal station 22 removes a predetermined amount of carrier from the recording element as a whole, and before a durability characteristic of the recording element is increased, any remaining carrier is trapped in the underlying layer. One or both of the layers, preferably at least the uppermost layer, are converted by converting station 24 such that a durability characteristic of the recording element as a whole is increased.

Examples of suitable recording elements include those described in U.S. Pat. No. 6,497,480 B1 issued to Wexler on Dec. 24, 2002; U.S. Pat. No. 6,475,603 B1 issued to Wexler on Nov. 5, 2002; and U.S. Pat. No. 6,399,156 B1 issued to Wexler et al. on Jun. 4, 2002; and U.S. application Ser. Nos. 10/289,862 of Yau et al. filed Nov. 7, 2002; 10/260,665 and 10/260,663 both of Wexler et al. filed Sep. 30, 2002; and 10/011,427 of Yau et al. filed Dec. 4, 2001.

Additional examples of suitable recording elements include any recording element known in the industry as being fusible, or any recording element that utilizes the incorporated approach, as described above. Other suitable recording element examples include those described in U.S. Pat. No. 5,374,475, issued to Walchli, on Dec. 20, 1994; U.S. Pat. No. 6,357,871 B1, issued to Ashida et al., on Mar. 19, 2002; U.S. Patent Applications 2002/0008747 A1; 2002/0048655 A1; European Patent Application 1,078,775 A2; Japanese Unexamined Patent Publication No. 01-182081, in the name of Akitani et al.

The size of the recording element can be any size appropriate for its intended use. For example, the recording element can be used as labels or tape and have a width of less than 0.25 cm (0.1 in) and any length. Alternatively, the recording medium can be used as signage and have a width of over 183 cm (72 in). The recording element can be of the type used in the medical imaging industry and have dimensions of 35.6 cm by 43.2 cm (14 in by 17 in). Or, the recording element can have dimensions typically associated with photographic images of various sizes, for example, 8.89 cm×12.7 cm (3.5×5 inch format); 10.16 cm×15.24 cm (4×6 inch format); 20.32 cm×25.4 cm (8×10 inch format); etc.

Figure 2:
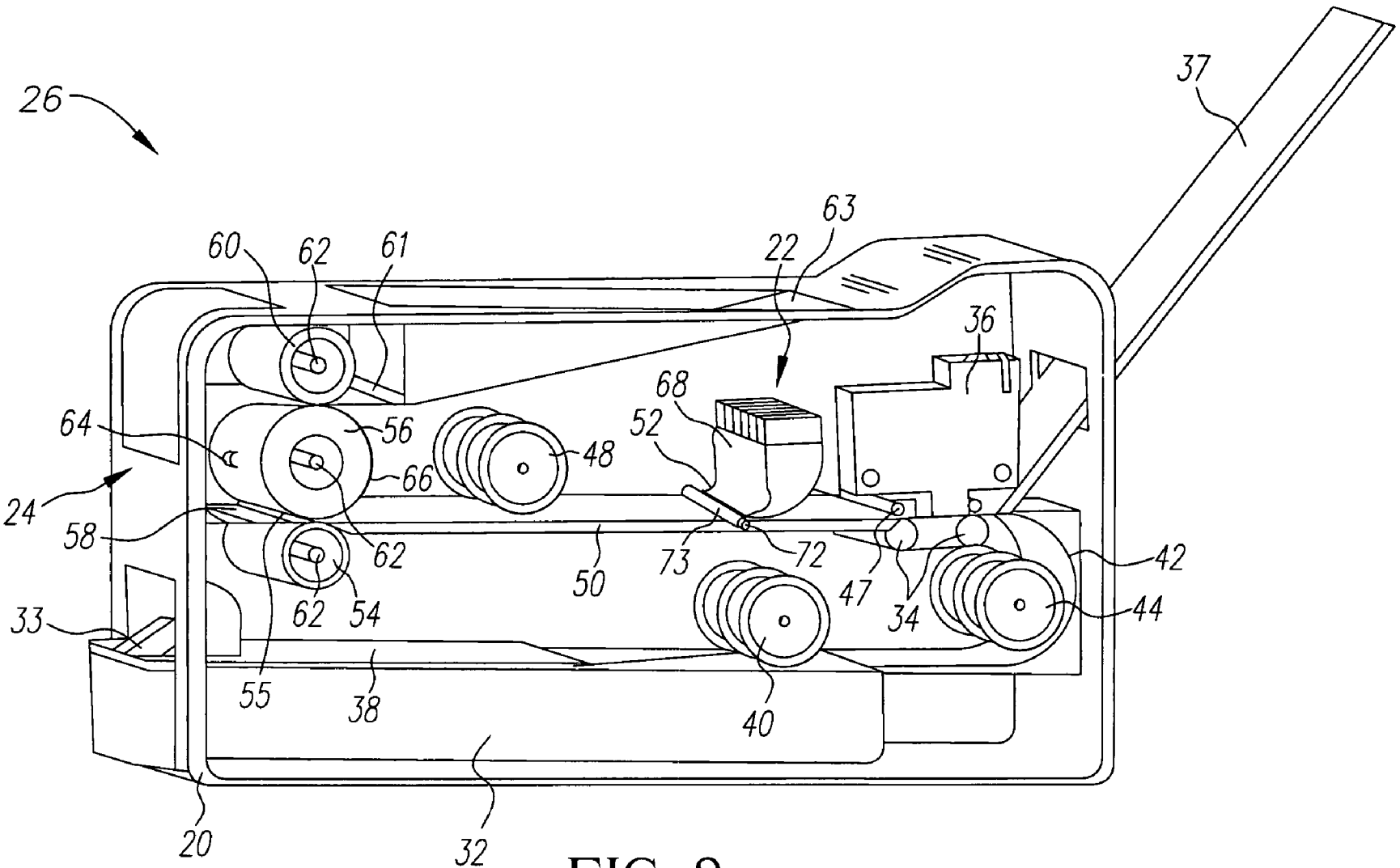
FIG. 2 is a schematic perspective view of an example embodiment of the invention.

Referring to FIG. 2, an example embodiment of recording element treating apparatus 20 is shown incorporated into inkjet printing system 26. Inkjet printing system 26 includes a removable recording element supply tray 32, a recording element conveying system (shown generally using 34), and a printhead 36. Supply tray 32 can be replenished with recording element 38 by removing supply tray 32 from printing system 26 using a handle 33, filling supply tray 32 with additional recording element 38, and reinserting supply tray 32 into printing system 26. Printing system 26 can also include an auxiliary recording element feed supply 37. In alternative embodiments, printing system 26 can include any number of components known in the industry.

During operation, recording element 38 is caused to move from supply tray 32 by recording element picking wheels 40 and caused to travel through a recording element supply chute 42 by recording element urging wheels 44. After exiting supply chute 42, an image and/or text is printed on recording element 38 by printhead 36 (included in a printing station 46). Conveying system 34 including one or more driven pinch wheels 47 moves recording element 38 through printing station 46. Intermediate transport wheels 48 move printed recording element 38 over a transport platform 50 toward treating apparatus 20.

Treating apparatus 20 includes a carrier removal station 22 which includes a device(s) 52 that removes carrier from recording element 38. In the embodiment shown in FIG. 2, device 52 includes a forced air convection element 68 and one or more infrared lamps 69 that produce heat that evaporates or removes carrier from recording element 38. Depending on temperature conditions inside carrier removal station 22, carrier removal station 22 can also preheat recording element 38 as recording element 38 moves toward converting station 24, using for example, device 52. Doing this can result in increased productivity (commonly referred to as thru-put) in apparatus 20.

Recording element 38 enters converting station 24 by passing through a transport roller 54 and a roller 56 which form a transporting nip 55. The relative positions of roller 54 and roller 56 are such that the pressure created and applied to recording element 38 by roller 54 and roller 56 is sufficient to move recording element 38 around an inverter chute 58 without significantly altering a durability characteristic of recording element 38. Inverter chute 58 also functions as a shield helping to maintain the operating temperature of the converting station 24.

Recording element 38 then passes through a pressure roller 60 and roller 56 which form a converting nip 61. The relative positions of roller 60 and roller 56 are such that the pressure created and applied to recording element 38 by roller 60 and roller 56 is sufficient to increase a durability characteristic of recording element 38 as recording element 38 travels through roller 60 and roller 56. Recording element 38 exits treating apparatus 20 coming to rest in an exit tray 63.

Depending on the desired application, roller 56 (and/or roller 60 and/or roller 54) can be hollow and include a heating element 62 (for example, a halogen lamp, etc.) that elevates the temperature of the converting station 24 and helps with the durability characteristic change. Typically, heating element 62 is located within roller 60 and/or roller 56. However, heating can also be included in roller 54 to preheat recording element 38 prior to recording element 38 reaching roller 60. Doing this decreases the temperature gradient between recording element 38 and roller 60 which can decrease the likelihood of image defects and can increase the speed at which rollers 54, 56, 60 are operated. A temperature sensor 64 (connected to a temperature control device located, for example, in controller 30 of printing system 26 or controller 25 of apparatus 20), can be included in the converting station 24 to monitor temperature inside the converting station 24. A shield 66 can also be positioned where needed to protect components of printing system 26 and/or treating apparatus 20 from excessive heat, etc. If desired, an additional heating element can be positioned within the cavity formed by roller 56 and shield 66 in order to preheat recording element 38 as described above.

In the embodiment shown in FIG. 2, converting station 24 can be of other types depending on the contemplated application. For example, converting station 24 comprises a pressure roller and a second roller to form the converting nip. Again, the relative positions of the pressure roller and the second roller are such that the pressure created and applied to recording element by the rollers is sufficient to alter a durability characteristic of the recording element as the recording element travels through the rollers.

The pressure roller and/or the second roller can also be hollow and include a heating element (for example, a halogen lamp, etc.) that elevates the temperature of the converting station and assists with the durability characteristic change. A temperature sensor can be included in the converting station to monitor the temperature inside the converting station.

Alternatively, the converting station can consist of a belt-fusing system. Such systems are well known to those skilled in the art of electrophotographic copying and are disclosed, for example, in U.S. Pat. Nos. 5,258,256 and 5,783,348. A belt-fusing system consists of a belt wrapped around a pair of stainless steel rollers. The belt is pressed against the third roller to form the converting nip. The belt (or both the belt and the third roller) is heated to provide energy for fusing the recording element.

Figure 3:
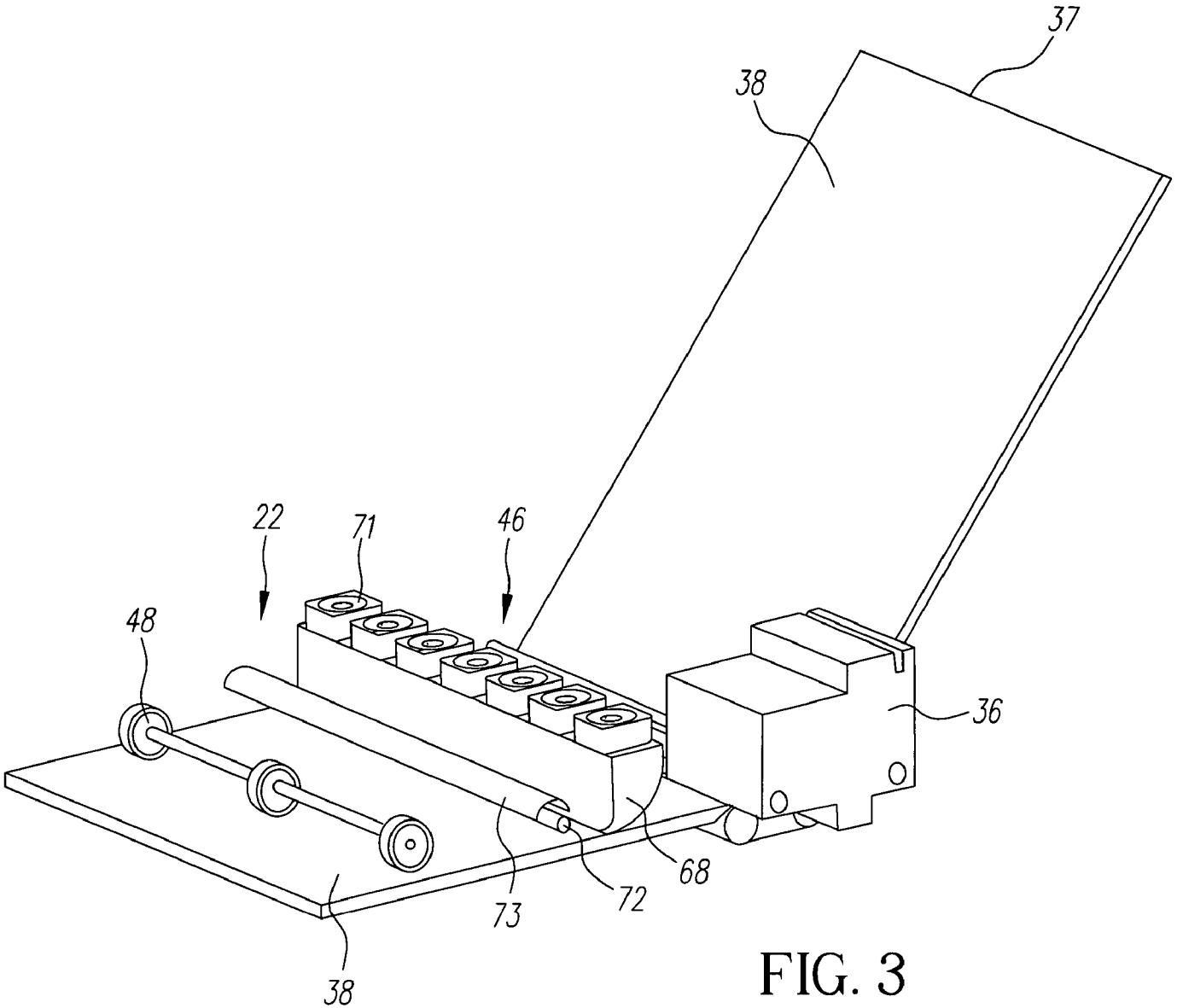
FIG. 3 is a schematic perspective view of another example embodiment of the invention.

Referring to FIG. 3, in this embodiment, recording element 38 is caused to move by the conveying system from the auxiliary recording element feed supply 37 through the printing station 46 comprising a print head 36. An image and/or text is printed on the recording element 38 by print head 36.

Printed recording element 38 enters the carrier removal station 22 which includes a forced air convection element 68 (commonly referred to as a blower) and an infrared (IR) heater 72. Typically, carrier removal station 22 is positioned closer to converting station 24 when preheating is desired, however, specific applications may require that carrier removal station 22 be positioned spaced apart from converting station 24. The forced air convection element 68 includes a series of fans 71 which first blow air through the large opening of the element 68 then through the small opening of the element. This produces an airflow (air at ambient temperature or heated air) of high velocity onto the area of the printed recording element 38 exposed to the heat radiation emitted from the IR heater 72.

This process helps to evaporate at least some ink carrier present in recording element and remove the water vapor generated by the IR heater. This process also enhances the drying rate of the printed recording element and decreases the likelihood of surface defects such as cracking and yellowing. An exhaust and duct system can be also used to remove the large amount of water vapor (generated by the IR heater) from the printer thus eliminate unfavorable effects, such as condensation on other parts inside the printer.

The IR heater 72 is located away from the print head 36. So there will be no heating effect on the print head, and no dry out of ink at or near the nozzles affecting the ejection performance of the nozzles.

Figure 4A:
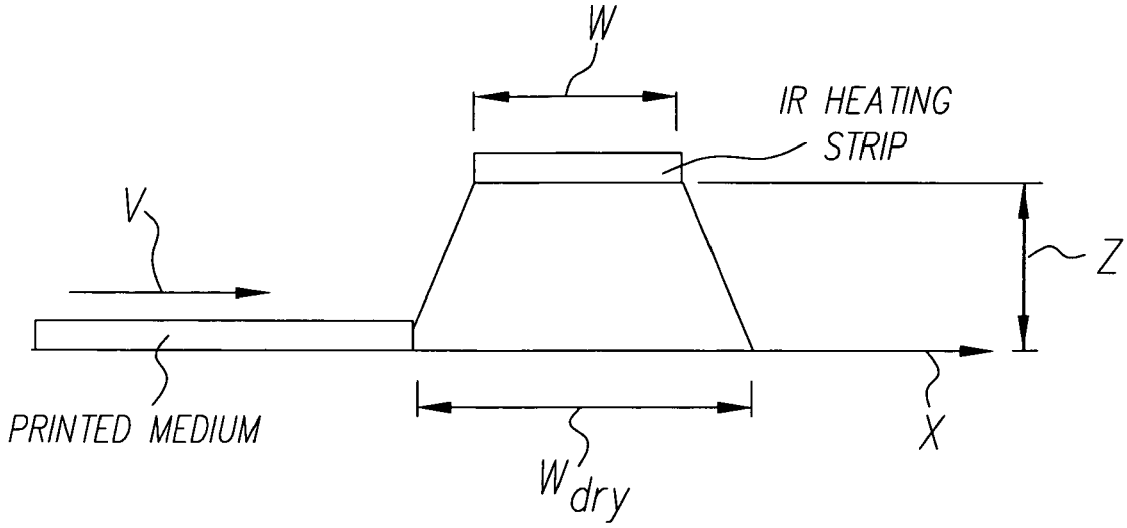
FIG. 4A shows the cross sectional view of an infrared heater comprising a single heating element.
Figure 4B:
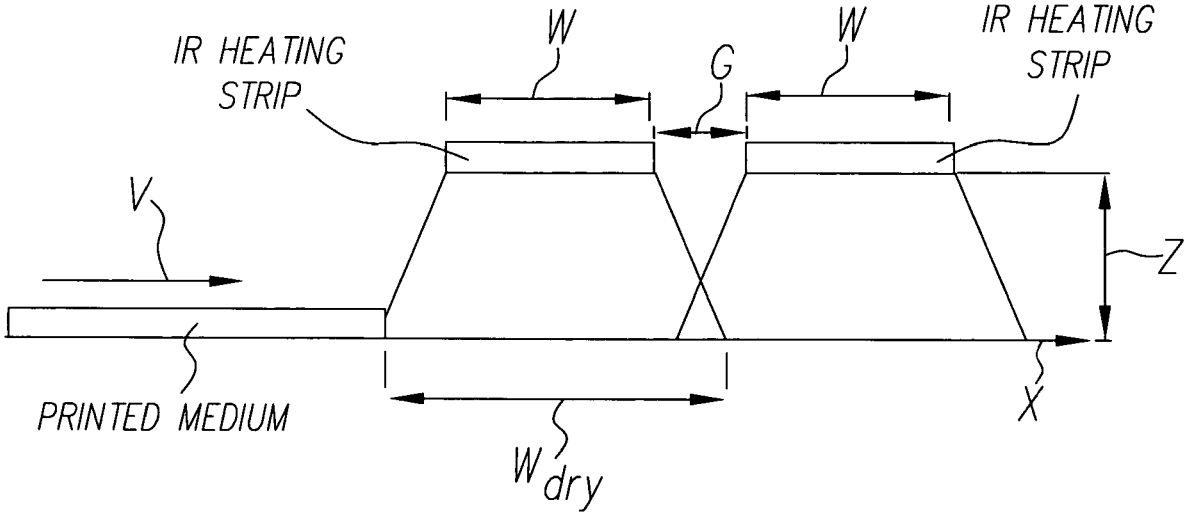
FIG. 4B shows the cross sectional view of an infrared heater comprising two parallel heating elements.

The IR heater 72 includes one or two long rectangular heating strips as shown in FIGS. 4A and 4B, and a gold plated reflector 73. The heating strips are made of carbon, quartz, tungsten, or other ceramic materials. The gold plated reflector 73 directs the heat radiation emitted from the heating strips onto the printed recording element 38.

Referring to FIGS. 4A and 4B, the width and length of the heating strips are W and L, respectively. The printed recording element is transported to the drying zone of the IR heater at a speed of v. The IR heater is located at a distance of z from the printed recording element, and the surfaces of the heating strips are approximately parallel to the printed recording element.

Exposure Absorbed by the Printed Recording Element

The spectral irradiance at any point P(x, y, z) on the printed recording element with its plane parallel to the heater plane can be calculated by $$E_\lambda(x, y, z) = \frac{M_\lambda}{\pi} \cdot f(x, y, z, W, L) \tag{1}$$

where $M_\lambda$ is the spectral radiant exitance of the heater, and f(x,y,z,W,L) is a geometric factor that depends on the illuminating configuration and the heater dimensions.

The exposure (heat energy per unit area) incident to the printed recording element is given by $$H(y, z) = \int_0^\infty d\lambda \int_0^{t_{exp}} E_\lambda dt \tag{2}$$

Here, $t_{exp}$ is the exposure time and is equal to the ratio of the width of the drying zone ($W_{dry}$) to the transport speed of the recording element (v).

The exposure absorbed by the ink and the recording element are given by $H_{ink}$ and $H_{medium}$, respectively, $$H_{ink}(y, z) = \int_0^\infty A_{ink}(\lambda) d\lambda \int_0^{t_{exp}} E_\lambda dt, \tag{3}$$

$$H_{medium}(y, z) = \int_0^\infty (1 - A_{ink}(\lambda)) A_{medium}(\lambda) d\lambda \int_0^{t_{exp}} E_\lambda dt, \tag{4}$$

where $A_{ink}(\lambda)$ and $A_{medium}(\lambda)$ are the spectral absorptance of the ink and recording element, respectively.

The total exposure absorbed by the printed recording element is simply $$H(y,z)=H_{ink}(y,z)+H_{medium}(y,z) \tag{5}$$

Emission Characteristics of IR Heater

The spectral radiant exitance $M_\lambda$ in Eq. (1) is given by the Planck radiation law, $$M_\lambda = \frac{c_1}{\lambda^5(e^{c_2/\lambda T} - 1)} \tag{6}$$

where $c_1$ and $c_2$ are constants, λ is the wavelength, and T is the color temperature of the heating element. The wavelength at which the emitting radiation is a maximum is given by the Wien displacement law, $$\lambda_m=2898/T \tag{7}$$

The total radiation M emitted by a gray body is given by the Stefan-Boltzmann law, $$M=\epsilon\sigma T^4 \tag{8}$$

where ϵ is the emissivity of the heating material, and σ is the Stefan-Boltzmann constant. Typical values of emissivity for tungsten and carbon are 0.39 and 0.53-0.84, respectively.

It is clear from Eqs. (6)-(8) that the emission characteristics of an IR heater depend on the color temperature of the heater, which in turn depends on the input voltage to the heater. The color temperature of the heater increases approximately linear with the input voltage. For of a typical IR heater (Model FSA 182 from Process Thermal Dynamics Inc.), at an input voltage of about 110 V, the resulting color temperature is about 966° K., and the wavelength of maximum radiation emitted is about 3.0 um. The total radiation emitted by the IR heater per unit area is about 49 kW/$m^2$.

Absorption Characteristics of Inkjet Inks and Recording Media

Figure 5:
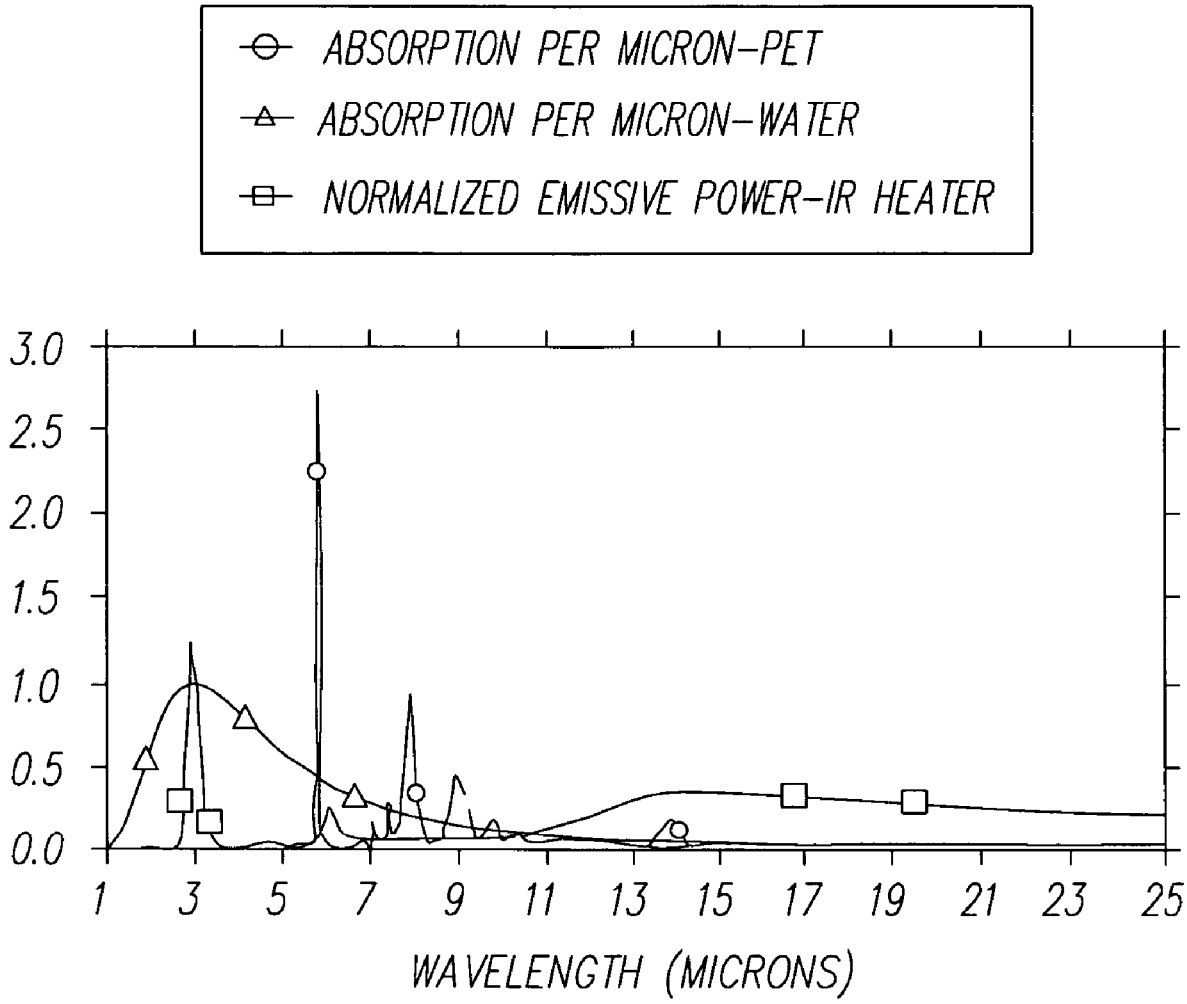
FIG. 5 shows the matching of emission spectrum of an infrared heater to the absorption spectrum of ink carrier.

Most of aqueous inks, either dye-based or pigment based, consist of more than 70% of water by weight. Therefore, the absorption characteristics of aqueous inks are primarily determined by the absorption characteristics of water. FIG. 5 shows the absorption spectrum of water, $A_{ink}(\lambda)$, indicating that its main absorption peaks are at about 3.0 um and 6.1 um. The strong absorption peak at 3.0 um is due to the H—H stretching vibration, and the weak absorption peak at 6.1 um, by the H—O—H deformation vibration. In addition, there is a broad but moderate absorption band at about 12 um-25 um.

The recording element used in the present invention may have two layers coated on a clear poly(ethylene terephthalate) [PET] support having a thickness of 0.175 mm. While the uppermost layer traps the colorant, the underlying layer mainly absorbs the remainder of the ink penetrating through the uppermost layer. The underlying layer, coated directly on the support, has a thickness of about 8 um and consists mainly of polyurethane dispersion, gelatin, and polymer latex. The uppermost layer, coated on the underlying layer, has a thickness of about 49 um and consists of 84 wt. % thermoplastic organic polymer particles and 14 wt. % polyurethane dispersion. The absorption spectrum of the whole recording element, $A_{medium}(\lambda)$, is similar to that of the PET support itself having a very strong absorption peak at about 5.8 um and a couple of moderate absorption peaks at about 8.0 um and 8.9 um.

FIG. 5 shows the emission spectrum of an IR heater at 966° K. superimposed on the absorption spectra of water and PET, illustrating the matching of the maximum emission peak of the IR heater at a wavelength of about 3.0 um with the strong absorption peak of water at a wavelength of about 3.0 um. As a result, the heating effect on ink becomes optimal.

Figure 6:
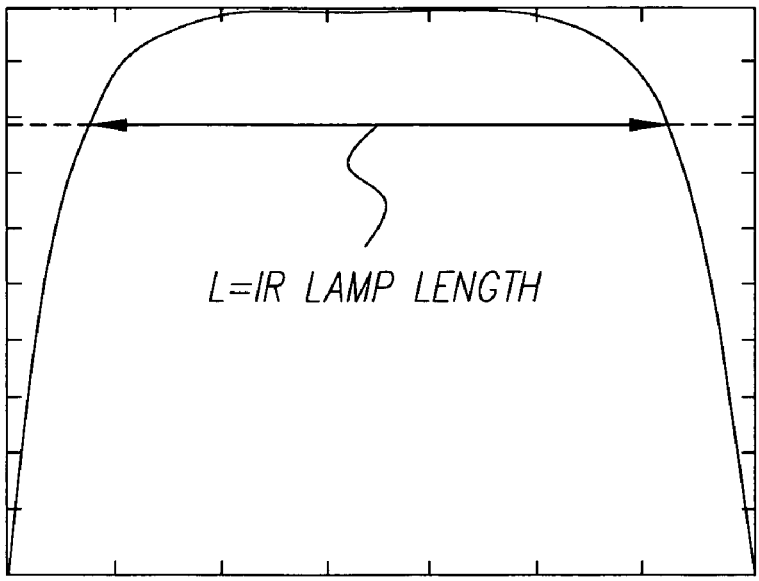
FIG. 6 shows the normalized exposure at the printed recoding element along the axial direction.

Using Eqs. (1)-(5), the emission spectrum of the IR heater, and the absorption spectra of ink and recording element as shown in FIG. 5, we can obtain the total exposure absorbed by the printed recording element. FIG. 6 shows the normalized exposure along the axial direction absorbed by the printed recording element illuminated by an IR heater having a single heating strip as shown in FIG. 3. Here, the length of the IR heater is assumed to be the same as the width of the recording element. Typical sizes of radiographs are 8"×10", 11"×14", and 14"×17", and the size of 14"×17" is the most common one. If the length of the IR lamp is the same as the width of the recording element, there will be a significant drop-off (about 50%) in exposure near the edges of the printed recording element, resulting in non-uniform drying across the width of the recording element. Due to the significant exposure drop-off near the edges, the 14"-wide printed recording element that is uniformly dried (within 10%) is only 10.8". In order to achieve uniform drying (within 10%) of a printed recording element across its entire width of 14", an IR heater with a length of 17.2" is needed. However, the increase in the IR heater length would not only increase the dryer size, but also its cost.

Energy Requirement for Drying the Printed Recording Element

The energy per unit area required to vaporize a given amount of water ($m_3$) from the printed recording element is the sum of the energy required to raise the temperature of the absorbed ink and the recording element from the ambient temperature ($T_1$) to the boiling point of ink ($T_2$) and the energy required for water vaporization, $$Q = \int_{T_1}^{T_2} \rho_1 t_1 c_1 dT + \int_{T_1}^{T_2} m_2 c_2 dT + m_3 L_3 \tag{9}$$

where $\rho_1$, $t_1$, and $c_1$ are the density, thickness, and heat capacity of the recording element, respectively; $m_2$ and $c_2$ are the mass per unit area and heat capacity of ink, respectively; $m_3$ and $L_3$ are the mass of vaporized water and the latent heat of vaporization for water, respectively. For example, for an ink coverage of 2.2 mg/cm$^2$ with 70% water, the energy required to remove 80% of ink carrier is about 91 kJ/m$^2$.

Operating Parameters for the IR Heater

Figure 7:
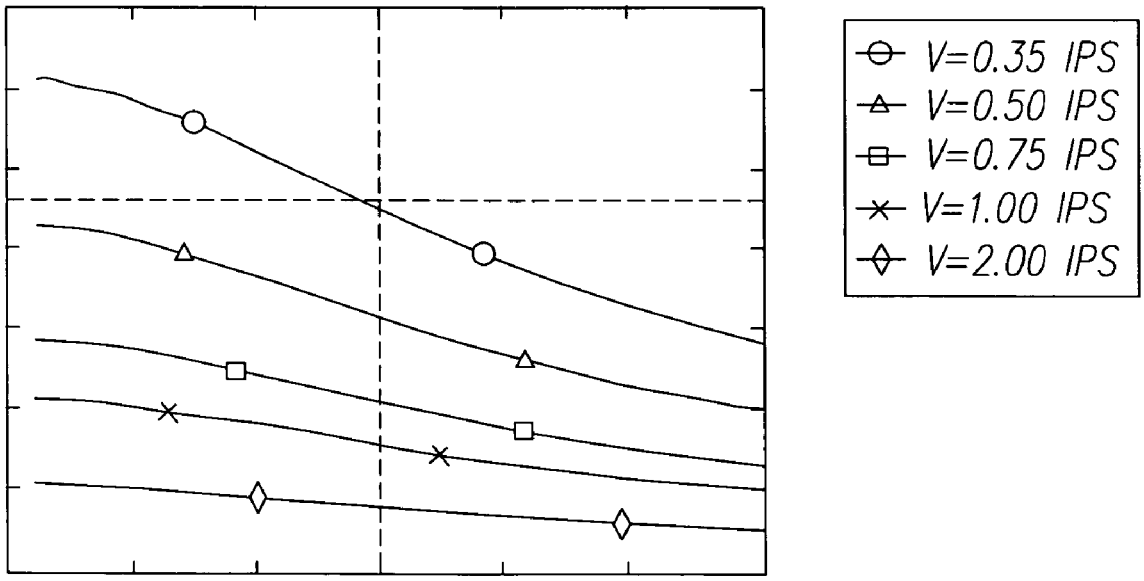
FIG. 7 shows the dependence of the total exposure absorbed by the printed recording element on the heater-recording element distance and the transport speed.

The operating parameters for the IR heater are the voltage applied to the IR heater (V), the distance between the heater and the printed recording element (z), the width of the drying zone ($W_{dry}$), and the transport speed of the recording element (v). FIG. 7 shows the dependence of the total exposure absorbed by the printed recording element on the heater-recording element distance and the transport speed. At a heater-recording element distance of 1.5" and a transport speed of 0.35 ips, the total exposure absorbed by the printed recording element is about 91 kJ/m$^2$, sufficient to remove 80 wt. % of ink carrier before the printed recording element is transported to the converting station for durability treatment. If the heater-recording element distance is larger than 1.5" or/and the transport speed is higher than 0.35 ips, the amount of absorbed energy will not be enough to remove the predetermined percentage of carrier in order to prevent defects such as blistering, sweating, and cracking from occurring during and after the converting step. Blistering is undesirable and appears as rough spots in which at least one of the layers of the recording element blisters or swells to form a bubble which then ruptures. Blistering is presumably caused by the diffusion of water through and out of the uppermost fusible layer of the recording element, i.e. evaporation of the water, as a result of heating during the converting step. The amount (or percentage) of carrier removed typically depends on the particular application and the characteristics of the recording element 38. Generally stated, the percentage of carrier removed is the minimum amount necessary to prevent defects from occurring after the durability characteristic of recording element 38 has been altered (for example, increased) by converting station 24. Typically, at least about 50% to at least about 99% of the carrier present in printed recording element 38 is removed by carrier removal station 22, although percentages will vary depending on the application. Preferably, at least 60% of the carrier is removed, more preferably at least 70%, still more preferably at least 80%, and still more preferably at least 90% of the carrier is removed. Controller 25 can include data that optimizes operational settings depending on the desired removal percentage.

The carrier amount (or percentage) is removed while recording element 38 is in the carrier removal zone. The carrier removal zone can include the carrier removal station 22 and/or the distance between the carrier removal station 22 and the converting station 24. The distance between stations 22 and 24 is not particularly limited. As such, carrier removal station 22 can be positioned adjacent to converting station 24 or carrier removal station 22 can be positioned spaced apart from converting station 24. Generally, the carrier removal zone is optimized depending on application so that the predetermined amount (or percentage) of carrier can be removed. The appropriate length of the carrier removal zone often depends on the transport speed of recording element 38, the temperature of the carrier removal station 22, and/or the amount and nature of the carrier to be removed.

Figure 8:
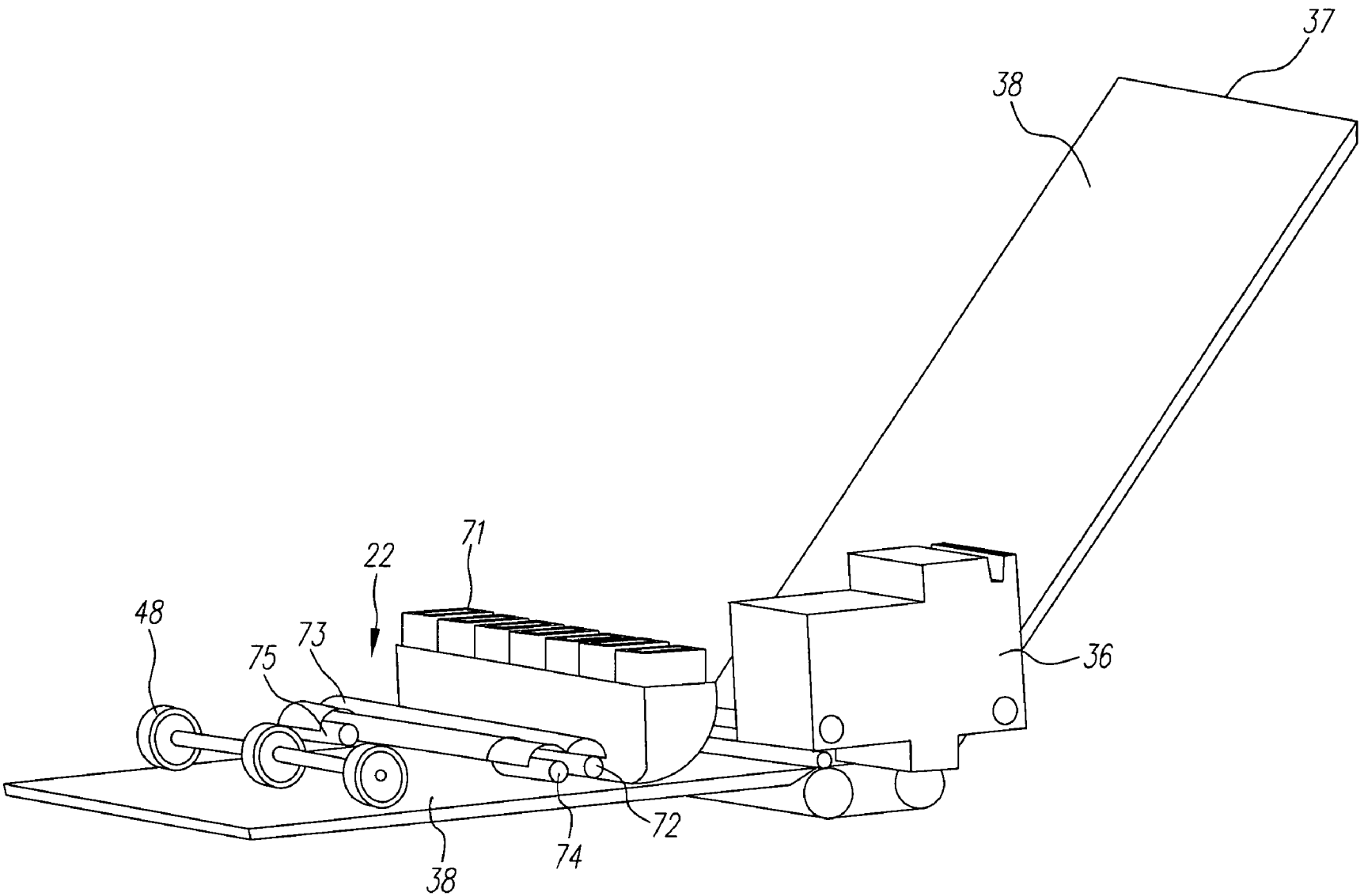
FIG. 8 is a schematic perspective view of another example embodiment of the invention.
Figure 9:
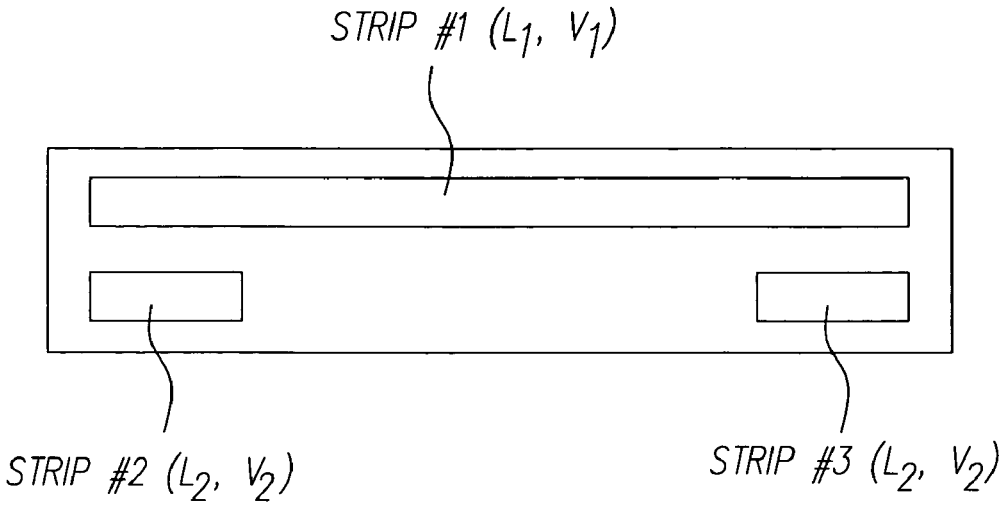
FIG. 9 shows the configuration of an infrared dryer providing uniform drying of a wide printed recording element.
Figure 10:
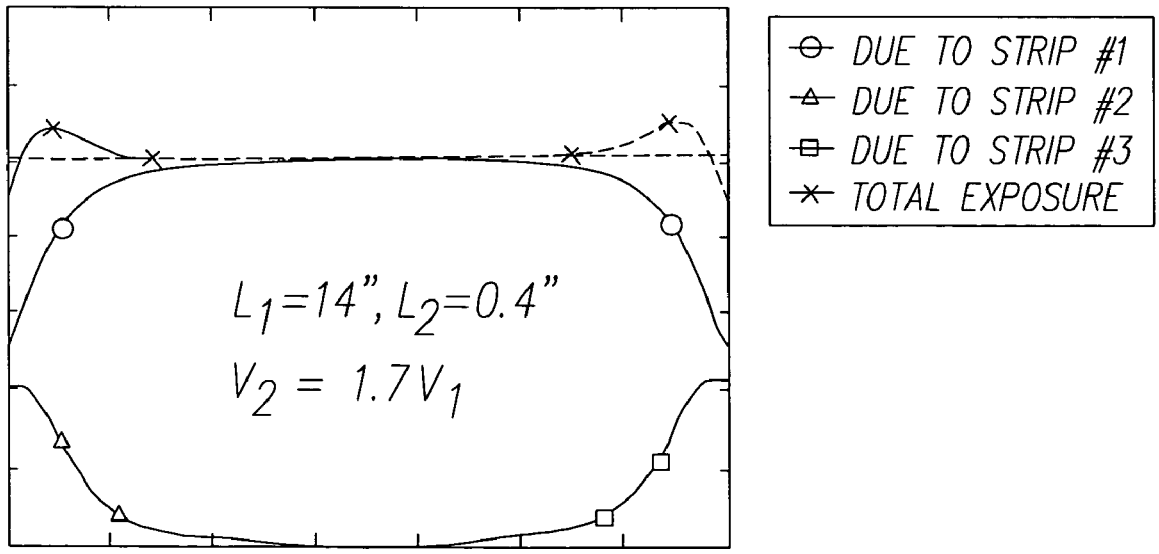
FIG. 10 shows the normalized exposure at the printed recoding element along the axial direction due to the infrared dryer shown in FIG. 9.

Referring to FIG. 8, an example embodiment of IR heater is shown incorporated into the carrier removal station to provide uniform drying of a wide printed recording element. In this embodiment, the IR heater consists of three pieces of heating strips as shown in FIG. 9, a long strip of length $L_1$ on one row and two short strips with length $L_2$ at the ends of the other row. The voltage applied to the two short strips ($V_2$) is higher than the long strip ($V_1$). FIG. 10 shows the normalized exposure along the axial (heater) direction at the printed recording element due to each of the three heating strips and the resulting total exposure. The exposures provided by the two short heating strips located at the ends of the heater compensate for the exposure drop-off near the ends due to the long heating strip, resulting in a uniform drying (within 10%) across the whole width of the printed recording element. The length of the two short heating strips and the drive voltage may be varied depending on the dryer configuration and the energy requirement for the drying of the printed recording element. This heater design allows the use of an IR dryer having a length equal to the width of the printed medium. Therefore, a compact printing system having excellent image quality can be realized. In addition, the distance between the IR heater and the printed recording element can be adjusted to provide enough energy to remove the predetermined percentage of carrier in order to prevent defects such as blistering, sweating, and cracking from occurring during and after the converting step.

Figure 11:
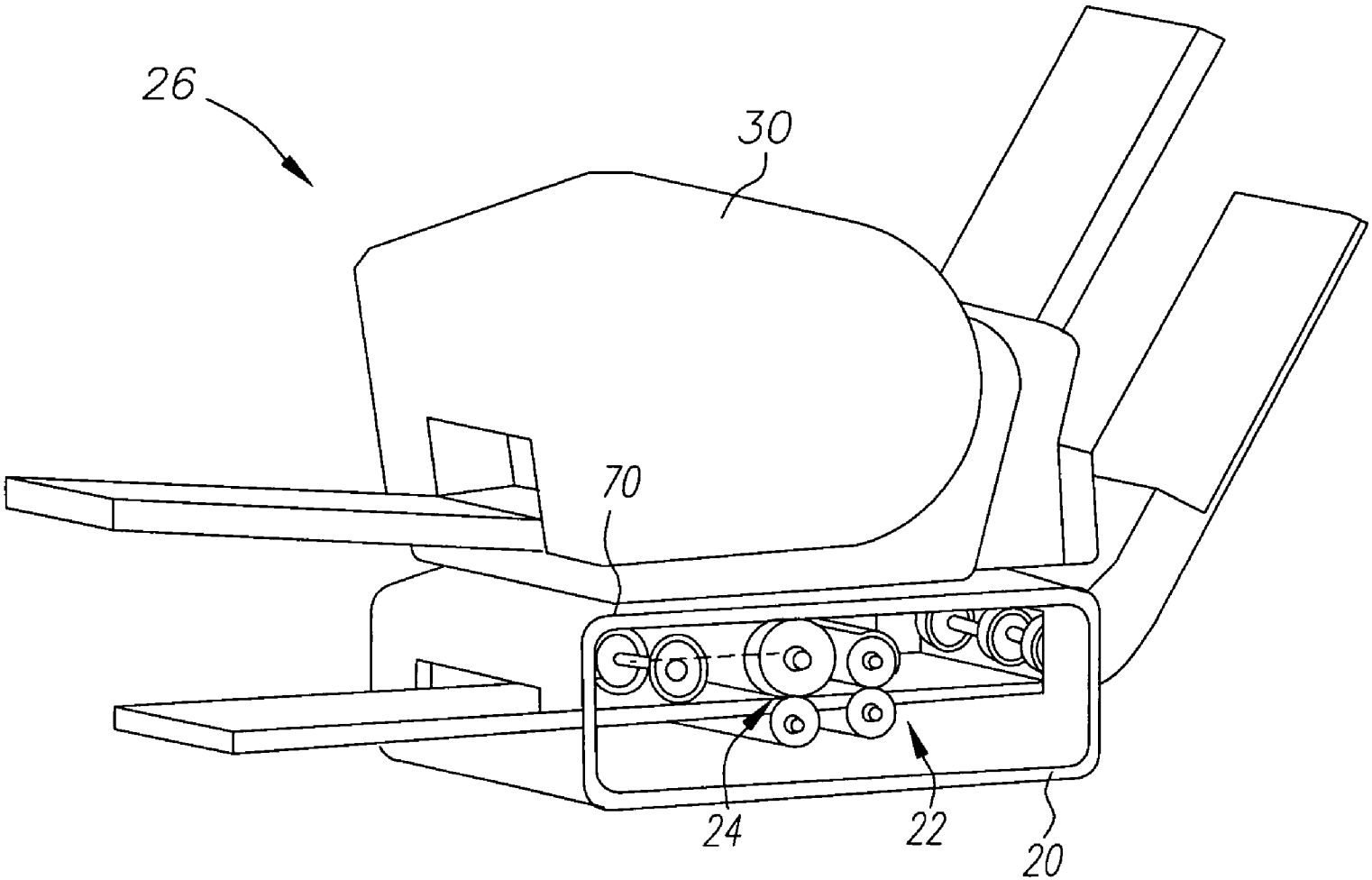
FIG. 11 is a schematic perspective view of another example embodiment of the invention with a printer.

Referring to FIG. 11, another embodiment of the recording element treating apparatus 20 is shown. Here, apparatus 20 is not incorporated into printing system 26. Rather, apparatus 20 is what is commonly referred to as a "stand alone" type device. Typically, this configuration of apparatus 20 is used with a "stand alone" type printing system 26. As shown in FIG. 11, printing system 26 can be placed on a top surface 70 of apparatus 20. Alternatively, apparatus 20 can be placed adjacent to or spaced apart from printing system 26. The footprint of apparatus 20 can be such that apparatus 20 is considered a desktop type device.

Experimental Results

Inkjet Recording Element

Polymer particles used in the inkjet recording element employed in the example were prepared as followed. A 12-liter, Morton reaction flask was prepared by adding 4000 g of de-mineralized water. The flask contents were heated to 80° C. with 150 RPM stirring in a nitrogen atmosphere. The initiator solution addition flask was made up with 1974 g of de-mineralized water and 26.4 g of 2,2'-azobis(2-methylpropionamidine) dihydrochloride. A monomer phase addition flask was prepared by adding 2419 g of ethyl methacrylate and 127 g of methyl methacrylate. Then, charges to the reaction flask from each addition flask were started at 5 g per minute. The addition flasks were recharged as needed. Samples were taken at various times and the monomer phase feed was stopped when a particle size of 753 nm was reached. The charges of the redox initiator solutions were extended for 30 minutes beyond the end of the monomer phase addition to chase residual monomers. The reaction flask contents were stirred at 80° C. for one hour followed by cooling to 20° C., and filtration through a 200 μm polycloth. The mixture was concentrated to 50 wt. % solids by ultra-filtration, the particles were monodispersed at about 850 nanometers in diameter.

The inkjet recording element employed in the example consisted of a two layers coated on clear poly(ethylene terephthalate)support having a thickness of 0.175 mm. The base layer, coated directly on the support, had a thickness of approximately 8 μm (dry laydown 8.16 g/m$^2$) and consisted of 58 wt. % Witcobond® W-213 polyurethane dispersion from Witco Corp., 28 wt. % Type 4 gelatin, 12 wt. % polymer latex of (vinylbenzyl)trimethylammonium chloride and divinylbenzene (87:13 molar ratio), 1.2 wt. % bis(vinyl sulfonylmethane), and 0.8 wt. % Olin® 10G surfactant from Dixie Chemical Co. A top layer, coated on the base layer, had a thickness of approximately 49 μm (dry laydown 35.7 g/m$^2$) and consisted of 84 wt. % polymer particles described in the previous paragraph, 14 wt. % Witcobond® W-320 polyurethane dispersion from Witco Corp., 1.4 wt. % GP-50-A silicone fluid from Genesee Polymers Corp., and 0.6 wt. % Zonyl® FSN fluorosurfactant from E. I. du Pont de Nemours and Co. All weight percent values are relative to the total weight of the layer. The thickness of the top layer was 36 μm after conversion was carried out as described below.

Black Pigment Ink

A mixture of 325 g of polystyrene beads having mean diameter of 50 μm, 30.0 g of Pigment Blue 15:3 (Sun Chemical Corp.); 10.5 g of potassium oleoyl methyl taurate (KOMT) and 209.5 g of deionized water was prepared. These components were milled for 8 hours in a double walled vessel at room temperature using a high-energy media mill manufactured by Morehouse-Cowles Hochmeyer. The mixture was filtered through a 4-8 μm Buchner funnel to remove the polymeric beads, and the resulting filtrate diluted to give a cyan pigment dispersion having a 10.0 wt. % final concentration of pigment. The median particle size of the pigment was 45 nm, as determined using a MICROTRAC II Ultrafine Particle Analyzer manufactured by Leeds & Northrup. Proxel® GXL (Avecia Corp.) was added at an amount necessary to give 230 ppm concentration.

A magenta pigment dispersion was prepared the same as the cyan pigment dispersion except that Pigment Red 122 (Sun Chemical Corp.) was used instead of Pigment Blue 15:3. The final concentration of pigment was 11.6 wt. %, and the mean particle size was 12 nm. A black pigment dispersion was prepared the same as the cyan pigment dispersion except that Pigment Black 7 (Cabot Corp.) was used instead of Pigment Blue 15:3. The final concentration of pigment was 12.3 wt. %, and the mean particle size was 60 nm.

An aqueous-based black pigment ink was prepared by combining the cyan pigment dispersion at 0.83 wt. %; the magenta pigment dispersion at 1.10 wt. %; the black pigment dispersion at 2.60 wt. %; diethylene glycol at 12.5 wt. %; glycerol at 2.75 wt. %; tripropylene glycol methyl ether (Dowanol® TPM from Dow Chemical Co.) at 2.50 wt. %; Surfynol® 465 (Air Products and Chemicals, Inc.) at 0.25 wt %; TruDot™ IJ-4655, a styrene-acrylic copolymer available from MeadWestvaco Corp. at 0.17 wt. %; and water to give 100 wt. %. The total amount of carrier (water) present in the pigment black ink was 81.3 wt. %. All weight percent values are relative to the total weight of the ink.

The pigment black ink was used in a test fixture to measure the drop absorption time for the recording element as described above. The method for the measurement of drop absorption time has been given in the literature ("Measurement and modeling of drop absorption time for various ink-receiver systems," by K. Yip et al. in IS&T's NIP 18 Proceedings, p. 378-382, 2002). The drop absorption time is defined as the time required for the recording element to completely absorb the impinging ink drop (i.e., the drop totally penetrates into the recording element and disappears from the surface of the recording element). In this example, the drop absorption time was measured to be less than 100 msec for a 16-pL drop. Since the recording element absorbs the impinging ink drops very fast, there will be no residual ink carrier on the surface of the recording element as the recording element enters the carrier removal station.

Printing

The black pigment ink was printed using the image PROGRAF W2200 Graphic Color Printer available from Canon, U.S.A., Inc. Two clean empty cartridges having catalogue numbers BCI-1302BK and BCI-1302PM were filled with the ink and placed into the black and light magenta positions, respectively, of the printer. A test image having a 7.62 by 10.16 cm single density patch was created using Adobe® PhotoShop® v7.0 software (Adobe Systems) in the 6-channel mode. The printer driver was overridden with software enabled through the PhotoShop® software such that the black pigment ink was printed from both cartridges in the Photo Paper Print Mode. The ink laydown was approximately 2.18 mg/cm$^2$ to give a carrier (water) laydown of 1.77 mg/cm$^2$. The area of the test patch was 77.4192 cm$^2$ so that the total amount of ink printed per test image was 169.00 mg, and the total amount of carrier (water) printed per test image was 137.03 mg.

Five samples of the inkjet recording element, each approximately 13 by 15 cm, were printed with the black pigment ink as described above. The weights of each of the samples were recorded before and immediately after printing and the results are given in Table 1.

Post-Printing Treatment—Carrier Removal

A carrier removal station comprising an IR lamp and forced air was employed in the example. For the IR lamp, the KL100 Infrared Emitter Module available from Heraeus Noblelight, Inc. was used. This module consisted of a medium wave twintube carbon emitter with gold reflector operating at a total bank power of 2200 watts and housed in high temperature stainless steel housing. The heated length of the module was 30 cm. The emitter temperature of the IR lamp was varied by adjusting, using a standard variable autotransformer, the amount of voltage delivered to the module. Ambient forced air was delivered using an Exair® Standard Air Knife available from Exair Corp. (gap setting 0.05 mm, length 30 cm). The line pressure of the air delivered to the air knife was 4.9 kg/cm$^2$ (70 psi).

Carrier was removed from each of the five printed samples described above as follows. Immediately after printing, a printed sample was laid on a unidirectional platen, about 30 by 30 cm, and held flat by an aluminum metal frame that contacted the outer edges of the imaged inkjet recording element (but not the single density patch). The platen transported the printed sample at a rate of 2.5 cm/sec underneath the IR lamp positioned about 7.6 cm above the platen. After passing by the IR lamp, the printed sample passed underneath the air knife positioned about 11.4 cm from the IR lamp and about 7.0 cm above the platen. The air from the air knife was directed at the platen at an angle of about 20° relative to the plane of the platen such that it was blown over the complete surface of the imaged recording element. For each printed sample, the voltage delivered to the IR lamp was varied such that the amount of carrier removed varied proportionately. Each sample was weighed immediately after it passed completely by the air knife. The amount of carrier removed was determined, and the results are shown in Table 1.

Post-Printing Treatment—Converting

A converting station comprising a belt-fusing system was employed in the example. Such systems are well known to those skilled in the art of electrophotographic copying and are disclosed, for example, in U.S. Pat. Nos. 5,258,256 and 5,783,348. The belt-fusing system consisted of a belt wrapped around a pair of stainless steel rollers. The belt was approximately 33 cm wide and consisted of Kapton® polyimide film (E.I. du Pont de Nemours and Co.) coated with a proprietary silicon-containing polymer provided by NexPress Solutions L.L.C. One of the stainless steel rollers was 6.9 cm in diameter and functioned as the fusing roller; the other stainless steel roller was 2.5 cm in diameter. Both rollers were 36 cm wide, and the distance between the two rollers was 23.0 cm (from center to center).

The fusing roller was positioned next to a third roller, 7.6 cm in diameter and 36 cm wide, which functioned as the pressure roller. The pressure roller was a stainless steel roller coated with silicon-rubber having a thickness of about 0.45 cm and a durometer hardness of about 85 Shore A units. The fusing and pressure rollers were positioned such that the nip width was 0.64 cm (0.25 in.) and the nip pressure was 4.6 kg/cm$^2$ (65 psi). Both the fusing and pressure rollers were hollow and were heated using lamps housed therein and along the axial direction. Temperature sensors were used to maintain constant temperature of the surfaces of the rollers, which was 149° C. for the fusing roller and 99° C. for the pressure roller. The printed sample was fed into the converting system with the image side of the media facing the belt.

After weighing each of the samples after the carrier removal step, each was passed through the converting station comprising a belt fusing system at a transport rate of about 0.89 cm/sec and subsequently evaluated for artifacts. The results are shown in Table 1. Blistering is undesirable and appears as rough spots in which at least one of the media layers blisters or swells to form a bubble which then ruptures. Blistering is presumably caused by diffusion of water through and out of the topmost fusible layer of the media, i.e. evaporation of the water, as a result of heating during the converting step.

TABLE 1

| | | Sample Weight (mg) | | | | | |
|---|---|---|---|---|---|---|---|
| Sample # | Voltage (V) | Before Printing | Immediately After Printing | After Carrier removal Step | Change | Carrier Removed (wt. %) | Artifacts After Fusing |
| 1 | 83.4 | 5454.25 | 5623.25 | 5493.45 | 129.80 | 94.7 | none |
| 2 | 74.8 | 5520.33 | 5689.33 | 5564.32 | 125.01 | 91.2 | none |
| 3 | 65.2 | 5444.37 | 5613.37 | 5491.34 | 122.03 | 89.1 | none |
| 4 | 56.4 | 5445.62 | 5614.62 | 5497.01 | 117.61 | 85.8 | blistering |
| 5 | 48.1 | 5433.23 | 5602.23 | 5494.02 | 108.21 | 79.0 | blistering |

The above results show that the amount of carrier removed is directly proportional to the voltage supplied to the IR lamp. The lower the voltage, the lower the emitter temperature of the IR lamp and the less efficient it becomes for heating water within a printed sample. As a result, less water is removed in the carrier removal step. The above results also show that the amount of carrier removed has a direct effect on blistering during the converting step. If too much carrier remains in the sample after the carrier removal step, then blistering is observed. In this example, at least about 85 wt. % of the carrier needed to be removed in order to prevent blistering. In general, the minimum amount of carrier that needs to be removed will vary depending on the particular compositions of the ink and recording element, as well as the conditions employed in the carrier removal and converting steps.

The invention has been described in detail with particular reference to certain example embodiments thereof, but it will be understood that variations and modifications can be effected within the scope of the invention.

What is claimed is:

1. A carrier removal station comprising:

a heater positioned to direct heat toward an article travel path, the heat having an emission spectrum with a peak emission wavelength, the carrier having an absorption spectrum with a peak absorption wavelength, the peak emission wavelength of the heat substantially corresponding to the peak absorption wavelenth of the carrier, wherein the heater comprises:

a first heating element having a length L1, the length L1 extending along a maximum width of the article travel path, the article travel path defining an article travel direction;

a second heating element having a length L2, the length L2 being less than the length L1, the second heating element being positioned parallel to the first heating element and spaced apart from the first heating element relative to the article travel direction of the article travel path, one end of the second heating element being aligned with one end of the first heating element; and a third heating element having a length L3, the length L3 being substantially equal to the length of the second heating element L2, the third heating element being positioned parallel to the first heating element and axially aligned with the second heating element one end of the third heating element being aligned with a second end of the first heating element.

2. The carrier removal station of claim 1, wherein the first heating element is positioned at a first distance relative to the article travel path, and the second heating element and the third heating element are positioned at a second distance relative to the article travel path, the second distance being equal to the first distance.

3. The carrier removal station of claim 2, wherein the first heating element is operable at a first voltage V1, and the second heating element and the third healing element are operable at a second voltage V2, the second voltage being higher than the first voltage.

4. In a carrier removal station having a heater positioned to direct heat toward an article travel path defining an article travel direction, the heater comprising:

a first heating element having a length L1, the length L1 extending along a maximum width of the article travel path, the article travel path defining an article travel direction;

a second heating element having a length L2, the length L2 being less than the length L1, the second healing element being positioned parallel to the first heating element and spaced apart from the first healing element relative to the article travel direction of the article travel path, one end of the second heating element being aligned with one end of the first healing element; and a third healing element having a length L3, the length L3 being substantially equal to the length of the second healing element L2, the third healing element being positioned parallel to the first healing element and axially aligned with the second heating element, one end of the third healing element being aligned with a second end of the first healing element.

* * * * *

UNITED STATES PATENT AND TRADEMARK OFFICE

CERTIFICATE OF CORRECTION

PATENT NO. : 7,519,280 B2
APPLICATION NO. : 11/475696
DATED : April 14, 2009
INVENTOR(S) : Kwok-Leung Yip et al.

It is certified that error appears in the above-identified patent and that said Letters Patent is hereby corrected as shown below:

| | |
|---|---|
| Column 19, line 15 | In Claim 1, delete “wavelenth” and insert -- wavelength --, therefor. |
| Column 19, line 32 | In Claim 1, after “element” insert -- , --. |
| Column 20, line 9 | In Claim 3, delete “healing” and insert -- heating --, therefor. |
| Column 20, line 20 | In Claim 4, delete “healing” and insert -- heating --, therefor. |
| Column 20, line 22 | In Claim 4, delete “healing” and insert -- heating --, therefor. |
| Column 20, line 25 | In Claim 4, delete “first healing” and insert -- first heating --, therefor. |
| Column 20, line 25 | In Claim 4, delete “third healing” and insert -- third heating --, therefor. |
| Column 20, line 27 | In Claim 4, delete “healing” and insert -- heating --, therefor. |
| Column 20, line 28 | In Claim 4, delete “healing” and insert -- heating --, therefor. |
| Column 20, line 29 | In Claim 4, delete “healing” and insert -- heating --, therefor. |
| Column 20, line 31 | In Claim 4, delete “healing” and insert -- heating --, therefor. |
| Column 20, line 32 | In Claim 4, delete “healing” and insert -- heating --, therefor. |
| Column 20, lines 12-32 | Delete “4. In a carrier removal station having a heater positioned to direct heat toward an article travel path defining an article travel direction, the heater comprising:<br>a first heating element having a length L1, the length L1 extending along a maximum width of the article travel path, the article travel path defining an article travel direction;<br>a second heating element having a length L2, the length L2 being less than the length L1, the second heating element being positioned parallel to the first heating element and spaced apart from the first heating element relative to the article travel direction of the article travel path, one end of the second heating element being aligned with one end of the first heating element; and<br>a third heating element having a length L3, the length L3 being substantially equal to the length of the second heating element L2, the third heating element being positioned parallel to the first heating element and axially aligned with the second heating element, one end of the third heating element being aligned with a second end of the first heating element.” and<br>insert -- 4. In a carrier removal station having a heater positioned to direct heat toward an article travel path defining an article travel direction, the heater comprising:<br>a first heating element having a length L1, the length L1 extending along a maximum width of the article travel path, the article travel path defining an article travel direction;<br>a second heating element having a length L2, the length L2 being less than the length L1, the second heating element being positioned parallel to the first heating element and spaced apart from the first heating element relative to the article travel direction of the article travel path, one end of the second heating element being aligned with one end of the first heating element; and |

a third heating element having a length L3, the length L3 being substantially equal to the length of the second heating element L2, the third heating element being positioned parallel to the first heating element and axially aligned with the second heating element, one end of the third heating element being aligned with a second end of the first heating element. --.

Signed and Sealed this

Sixth Day of April, 2010

David J. Kappos

David J. Kappos
*Director of the United States Patent and Trademark Office*